US008286608B2

(12) United States Patent
Wagner

(10) Patent No.: US 8,286,608 B2
(45) Date of Patent: Oct. 16, 2012

(54) SEALING SYSTEM FOR AN OSCILLATING-PISTON ENGINE

(75) Inventor: Arnold Wagner, Winterthur (CH)

(73) Assignee: Peraves AG, Winterthur (CH)

( * ) Notice: Subject to any disclaimer, the term of this patent is extended or adjusted under 35 U.S.C. 154(b) by 933 days.

(21) Appl. No.: 12/280,153

(22) PCT Filed: Feb. 19, 2007

(86) PCT No.: PCT/CH2007/000088

§ 371 (c)(1),
(2), (4) Date: Oct. 29, 2008

(87) PCT Pub. No.: WO2007/095773

PCT Pub. Date: Aug. 30, 2007

(65) Prior Publication Data

US 2009/0188460 A1 Jul. 30, 2009

(30) Foreign Application Priority Data

Feb. 22, 2006 (CH) ..... 0277/06

(51) Int. Cl.

| | |
|---|---|
| ***F02B 33/44*** | (2006.01) |
| ***F01C 3/06*** | (2006.01) |
| ***F01C 9/00*** | (2006.01) |
| ***F01C 3/00*** | (2006.01) |
| ***F04C 18/00*** | (2006.01) |
| ***F04C 2/00*** | (2006.01) |

(52) U.S. Cl. ..... 123/241; 123/245; 123/18 R; 418/68; 418/37

(58) Field of Classification Search ..... 123/18 R, 123/18 A, 18 AA, 241; 418/68, 35–38
See application file for complete search history.

(56) References Cited

U.S. PATENT DOCUMENTS

| | | | | | |
|---|---|---|---|---|---|
| 1,890,612 | A | * | 12/1932 | Kempthorne | 418/68 |
| 1,904,373 | A | * | 4/1933 | Kempthorne | 418/68 |
| 2,228,193 | A | * | 1/1941 | Bancroff | 418/37 |
| 2,544,481 | A | * | 3/1951 | Bancroft | 418/37 |
| 2,547,374 | A | * | 4/1951 | Carideo | 418/37 |
| 2,553,954 | A | * | 5/1951 | Bancroft | 418/37 |
| 3,658,447 | A | * | 4/1972 | Bancroft | 418/37 |
| 3,816,038 | A | * | 6/1974 | Berry | 418/68 |
| 3,816,039 | A | * | 6/1974 | Berry | 418/68 |
| 3,922,118 | A | * | 11/1975 | Bancroft | 418/37 |
| 3,934,559 | A | * | 1/1976 | Cohen | 123/241 |

(Continued)

FOREIGN PATENT DOCUMENTS

DE 18 03 533 A1 5/1970

(Continued)

*Primary Examiner* — Thai Ba Trieu
(74) *Attorney, Agent, or Firm* — Kilpatrick Townsend & Stockton LLP

(57) ABSTRACT

A sealing system for oscillating-piston engines that include two oscillating pistons that revolve together in a spherical housing. The pistons perform reciprocating oscillating movements in opposite directions about an oscillation axis perpendicular to the axis of revolution for the pistons. Guide members are provided on the pistons and engage at least one guide groove formed in the housing. Sealing elements are disposed on or in the vicinity of all moving edges surrounding working chambers and prechambers for the engine. The sealing elements seal all the gap regions present between machine parts displaced relative to one another by revolving and/or oscillating movements and not in direct contact. Sealing elements prevent excessive penetration of lubricating fluid into inlet and outlet openings in the housing.

12 Claims, 4 Drawing Sheets

U.S. PATENT DOCUMENTS

| | | | | |
|---|---|---|---|---|
| 3,994,640 | A * | 11/1976 | Cohen | 418/68 |
| 6,390,052 | B1 * | 5/2002 | McMaster et al. | 123/247 |
| 7,469,673 | B2 * | 12/2008 | Wagner | 123/241 |
| 7,563,086 | B2 * | 7/2009 | Huttlin | 123/241 |
| 7,670,121 | B2 * | 3/2010 | Weatherbee | 418/68 |
| 2005/0135950 | A1 * | 6/2005 | Huettlin | 417/437 |
| 2005/0186100 | A1 | 8/2005 | Weatherbee | 418/68 |

FOREIGN PATENT DOCUMENTS

| | | | |
|---|---|---|---|
| DE | 103 61 566 | A1 | 7/2005 |
| EP | 0 145 626 | A1 | 6/1985 |
| EP | 1 726 779 | A1 | 11/2006 |
| JP | 56009691 | A * | 1/1981 |
| WO | WO 84/00997 | A1 | 3/1984 |
| WO | WO 02/33238 | A1 | 4/2002 |
| WO | WO 03/067033 | A1 | 8/2003 |
| WO | WO 2005/098202 | A1 | 10/2005 |
| WO | WO 2007/014752 | A1 | 2/2007 |

* cited by examiner

SEALING SYSTEM FOR AN OSCILLATING-PISTON ENGINE

CROSS-REFERENCE TO RELATED APPLICATIONS

This application is a National Stage of International Application No. PCT/CH2007/000088, filed Feb. 19, 2007, and which claims the benefit of Swiss Patent Application No. 277/06, filed Feb. 22, 2006, the disclosures of these applications being incorporated herein by reference.

BACKGROUND

The invention relates to a sealing system for oscillating piston engines comprising at least two oscillating pistons which revolve together in a spherical housing about an axis of revolution provided in the housing centre and which each have opposite piston arms which, when revolving, perform reciprocating oscillating movements in opposite directions about an oscillation axis perpendicular to the axis of revolution, wherein guide members are provided on at least two pistons, said guide members engaging in at least one guide groove formed in the housing for controlling the oscillating movements.

Such oscillating piston engines are internal combustion engines in which the work cycles of intake, compression, expansion and exhaust according to the Otto or diesel four-stroke method with external or self-ignition are effected by oscillating movements of the piston between two end positions.

Oscillating piston engines known from U.S. Pat. No. 3,075,506, WO 03067033, DE 10361566 and WO 2005/098202 have two working chambers between the opposing piston inner sides and two prechambers or auxiliary chambers between the likewise opposing piston rear sides, which alternately open and close in opposite directions due to oscillating movements. In WO 2005/098202, these four chambers in total are enclosed externally by the spherical housing and are delimited on the front sides by the connecting structure of the pistons between the piston arms in the manner of side walls. In the inner region the revolving shaft forms a substantially cylindrical bottom surface aligned coaxially to the oscillation axis so that cavities closed on all sides are formed from the four chambers, which cavities only communicate with one another or towards the outside temporally through openings in the spherical housing for flooding or emptying with fluid, i.e. air, combustion mixture or exhaust gas.

In the prechambers and working chambers negative pressure develops during the flooding and excess pressure develops during the compression and expansion which reaches up to 100 bar in the working chambers, which without sealing elements would result in power-consuming pressure losses during precompression, compression and expansion and to incursions of lubricating fluid into the chambers. In the aforementioned patent documents, no information is given on the sealing system

SUMMARY

It is therefore the object of the present invention to provide a sealing system for oscillating piston engines which reliably prevents the internal pressures in the chambers from blowing out, and the lubricating fluid required for the piston guide members, shaft bearings and sealing elements from penetrating into the chambers (working chambers and/or prechambers) or at least reduces this in such a manner that the present and future requirements relating to engine power, lubricating fluid consumption and exhaust gas emission values can be met.

According to the invention, both the prechambers and the working chambers are completely sealed, whereby all chamber surfaces which are movable with respect to one another, towards the housing and towards the revolving oscillating shaft are sealed in, around and/or off by sealing elements in the form of sealing rings and/or sealing strips. In addition, further sealing elements can be provided to keep openings in the spherical housing free for ventilation and emptying of the working chambers of lubrication fluid.

It is particularly advantageous if these sealing elements are formed as intermediate members in such a manner that they prevent direct contacts between pistons, housing, revolving oscillating shaft and optionally other machine parts, i.e. they function as sliding elements between the piston and the remaining aforesaid parts of the oscillating piston engine. A further advantage is achieved if sealing elements are held at least on one side in at least one groove radially or obliquely to the spherical housing and can expand or contract, for example due to spring tension in a sealing manner. If these sealing elements or their retaining grooves are supplied on one side with pressurised lubricating fluid, in addition to the spring pretension a sealing pressure is formed against the outside and among this a labyrinth sealing effect intensified by lubricating fluid against underblowing. Thus, even with material pairings such as light metal for pistons and grey iron for housing halves, if there is sufficient fitting clearance, any thermal expansion of the pistons with respect to the housing can be compensated in a sealing manner without jamming as a result of direct contacts.

Gaps between oscillating pistons placed on the oscillating shaft side parts of the revolving oscillating shaft and the oscillating shaft sides are sealed according to the invention by preferably metallic O-rings which are in any case slotted on the inside, wherein both the revolving oscillating shaft and the pistons in the O-ring region have almost hemispherical grooves adapted to the O-ring diameter, flattened with a degree of play. During thermal expansion of the pistons, the resiliently yielding, compressible O-ring can therefore compensate for this expansion in the flattening region without pressure losses.

According to the invention, the sealing of the working chambers and of the prechamber front sides is achieved with a circular piston ring of special cross-section. A web-shaped sealing strip is placed on the working chamber inner surfaces and a curved sealing strip following the contour of the respective prechamber inner surface is placed on the prechamber inner surfaces. The sealing of the four piston inner sides is provided by the respectively two working chamber or prechamber inner sealing strips. The penetration of lubricating fluid into the openings for filling and emptying the working chambers in the spherical housing is prevented or reduced by the shaping of these openings and by the sealing strips which are adapted thereto, curved and arranged on the periphery of the pistons in such a manner that during the revolving and oscillating movements of the piston, these openings are sealed laterally, i.e. against lubricating fluid penetrating from the guide grooves.

The invention is explained hereinafter with reference to the appended drawings.

DETAILED DESCRIPTION

Figure 1:
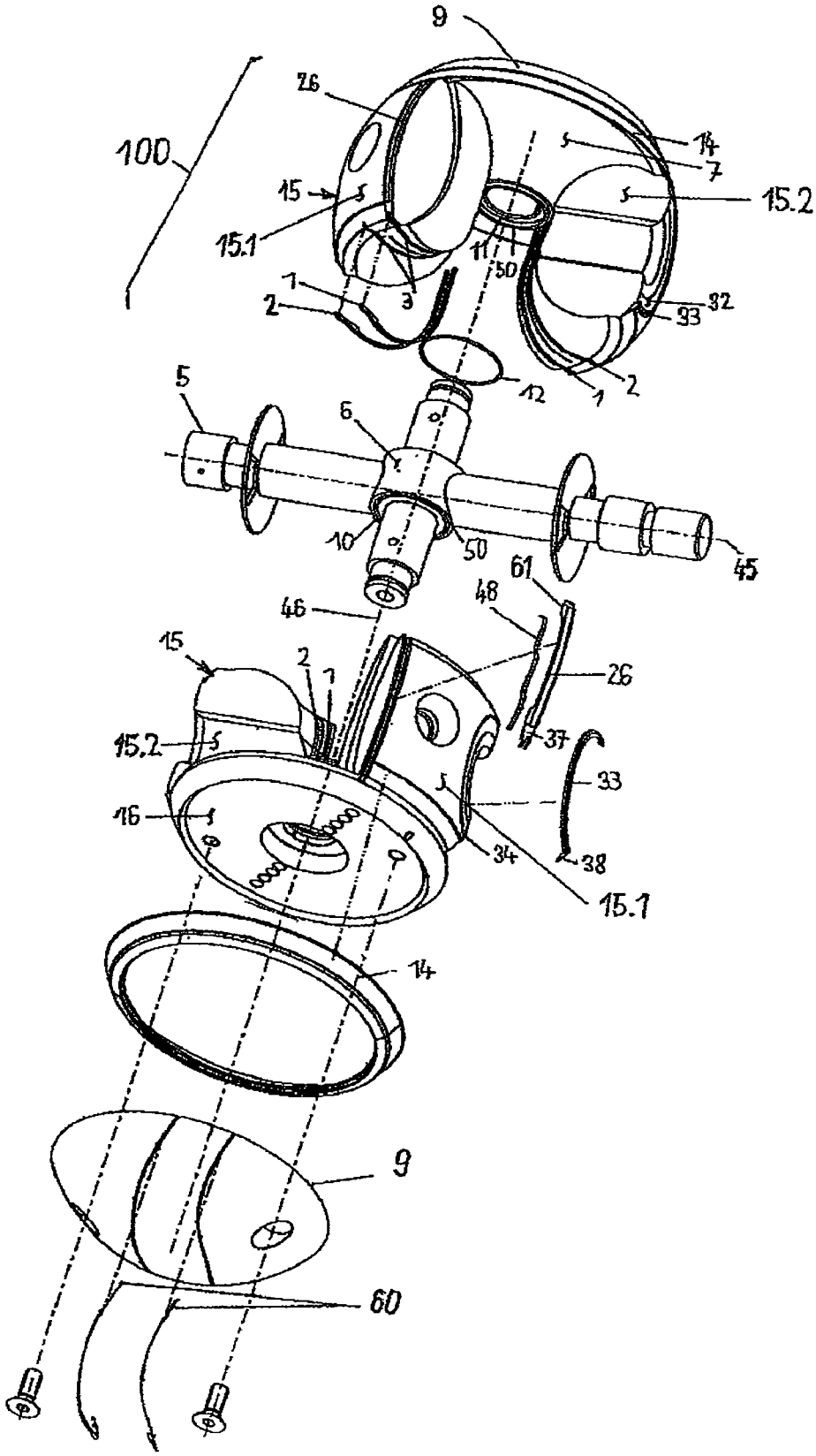
FIG. 1 shows a perspective exploded view of an oscillating piston engine 100 depicted without a housing 24, comprising a revolving oscillating shaft 5 which rotates about an axis of revolution 45, comprising two pistons 15 which are placed on the revolving oscillating shaft 5 on oscillating-shaft sides 10 and can oscillate about an oscillation axis 46, which pistons each have two piston arms 15.1 or 15.2 and a piston wall region 7 connecting the respective two piston arms 15.1 or 15.2, comprising spherical-segment-shaped dome covers 9 placed on the pistons 15, comprising circular piston rings 14, comprising web-shaped sealing strips 26 placed thereon and bent sealing strips 33 placed thereon, comprising a corrugated spring 48 as well as working chamber inner sealing strips 1 and prechamber inner sealing strips 2, comprising a metallic O-ring 12 which is slotted on the inside and arranged about the oscillating axis 46 and curved sealing strips 60 on one of the dome covers 9.

The oscillating piston engine 100 comprises, inter alia, a spherical housing 24, a revolving oscillating shaft 5 mounted at its ends in the housing wall and being revolvable about an axis of revolution 45 arranged at the centre of the housing, and two oscillating pistons 15 fastened to the revolving oscillating shaft 45. Each of the oscillating pistons 15 has two diametrically opposite piston arms 15.1 and 15.2 in relation to the axis of revolution 45 and is pivotably fastened to the revolving oscillating shaft 5 so that it can oscillate about an oscillation axis 46 perpendicular to the axis of revolution 45 in such a manner that the oscillating pistons 15 revolve together about the axis of revolution 45 during a revolution of the revolving oscillating shaft 5 about the axis of revolution 45 and in addition, when revolving, perform reciprocating oscillating movements in opposite directions about the oscillation axis 46. In order to control the respective position of the pistons relative to the axis of revolution 45 or to the oscillation axis 46, guide members 47 are attached to at least two pistons 15 which engage in at least one guide groove 39 formed in the housing 24, which is intended to control the oscillating movements.

In the case shown, the guide members 47 are each loose, spherical rotational bodies which are each mounted on the piston side in a retaining pan formed on one of the pistons 15, wherein the retaining pan is configured as hemispherical according to the shape of the respective rotational body. Such arrangements of guide members in the form of rotational bodies are disclosed, for example in WO 2005/098202.

The two oscillating pistons are arranged crosswise with respect to the oscillation axis 46.

The intermediate space between the (adjacent) piston arms 15.1 of the two pistons, respectively one piston wall region 7, one surface region 6 of the revolving oscillating shaft 5 and the inner side 20 of the housing 24 form a first working chamber 17 of the oscillating piston engine 100 and the (opposite in relation to the revolving oscillating shaft 5) intermediate space between the (neighbouring) piston arms 15.2 of the two pistons 15, respectively one piston wall region 7, one surface region 6 of the revolving oscillating shaft 5 and the inner side 20 of the housing 24 form a second working chamber 17 of the oscillating piston engine 100.

Accordingly the intermediate space between the piston arm 15.1 of one of the two pistons 15, the piston arm 15.2 of the other piston 15, respectively one piston wall region 7, one surface region 6 of the revolving oscillating shaft 5 and the inner side 20 of the housing 24 form a first prechamber 30 of the oscillating piston engine 100 and the (opposite in relation to the revolving oscillating shaft 5) intermediate space between the piston arm 15.2 of one of the two pistons 15, the piston arm 15.1 of the other piston 15, respectively one piston wall region 7, one surface region 6 of the revolving oscillating shaft 5 and the inner side 20 of the housing 24 form a second prechamber 30 of the oscillating piston engine 100.

The volume of the respective working chamber 17 and the respective prechamber 30 depends on the instantaneous position of the pistons 15 and fluctuates between a minimum and a maximum during revolution of the revolving oscillating shaft 5 or the pistons 15 about the axis of revolution 45.

In order to operate the oscillating piston engine 100 as an internal combustion engine, a fuel can be injected via an injection valve 70 guided through the housing 24 (depending on the position of the pistons 15) as desired into one of the two working chambers 17 and then ignited in the respective working chamber 17, wherein the combustion of the fuel causes an oscillating movement of the pistons 15 in respectively opposite directions about the oscillation axis 46 and accordingly a revolution of the pistons 15 or the revolving oscillating shaft 5 about the axis of revolution 45.

Figure 2:
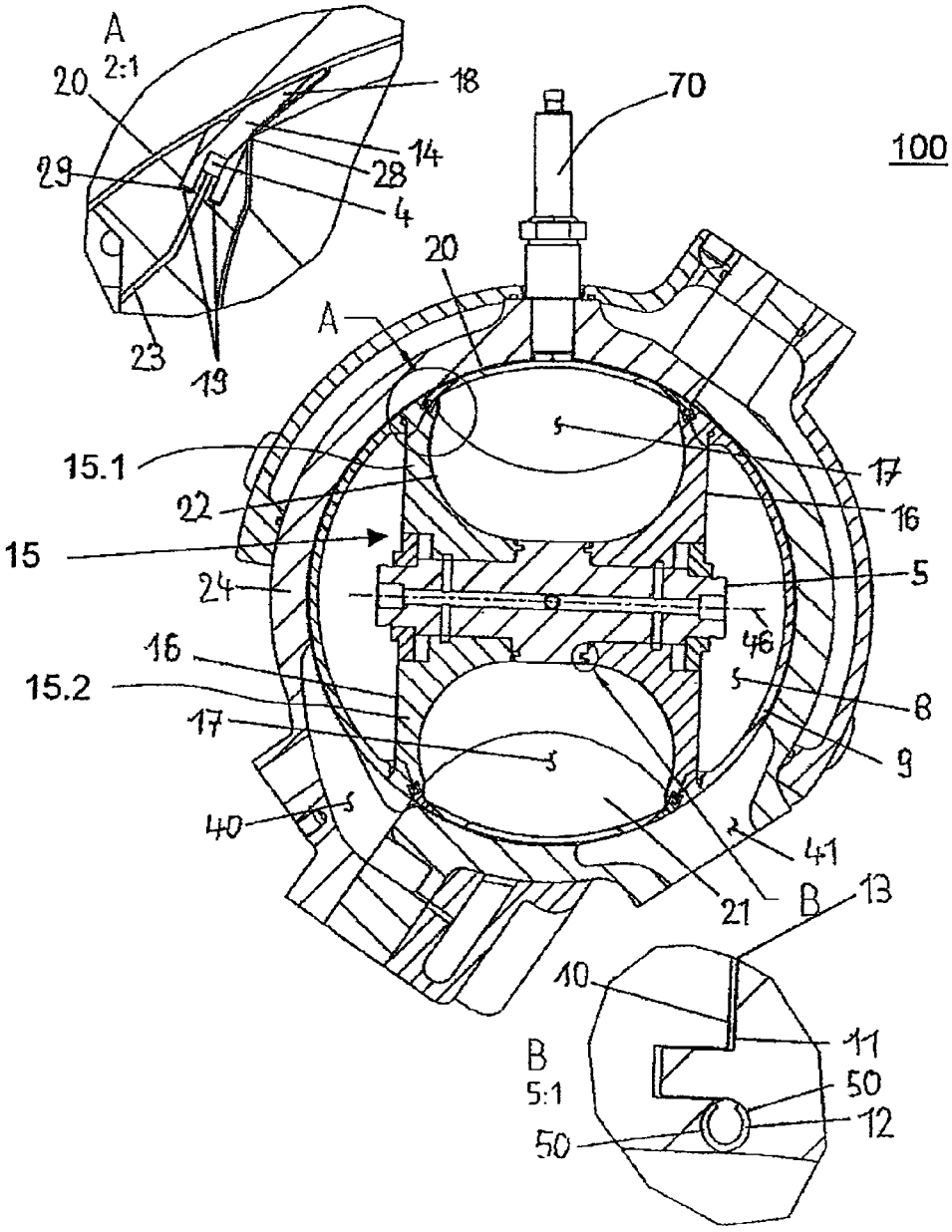
FIG. 2 shows the oscillating piston engine 100 according to FIG. 1, in a cross-section along the direction of the oscillation axis, comprising a housing 24, wherein the following are shown: details of the circular piston rings 14; details of oblique grooves 19 for receiving the respective piston ring 14 formed in the respective piston 15 (in the area of the respective piston wall region 7); details of spring spaces 4 formed between one of the piston rings 14 and the corresponding oblique groove 19 (as shown in the enlarged section A), details of the metallic O-rings 12 and flattened grooves 50 in the revolving oscillating shaft 5 and on the piston inner side in the area of the respective piston wall region 7 (as shown in the enlarged section B) and inlet opening 40 and outlet opening 41 in the housing 24.
Figure 3:
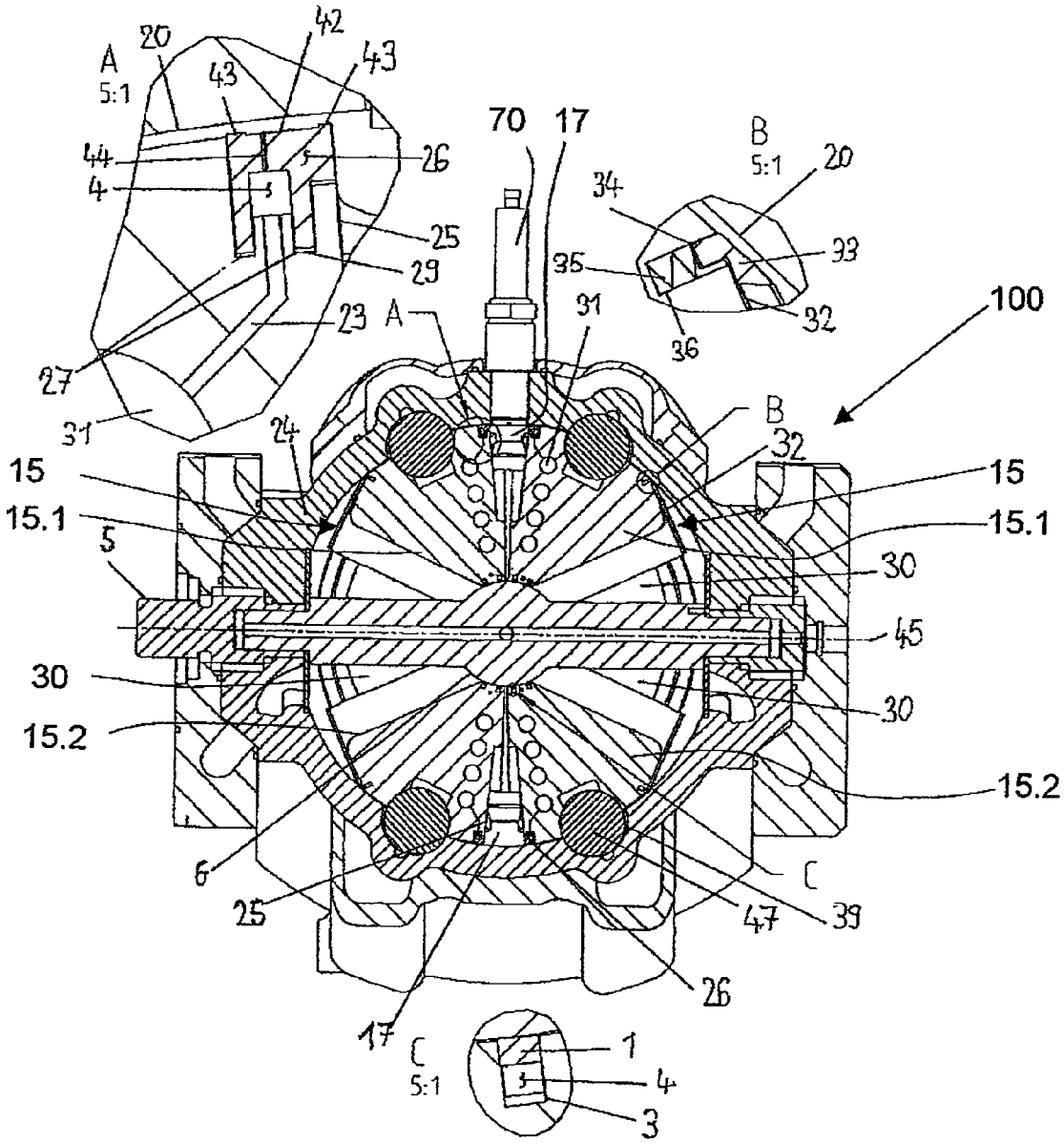
FIG. 3 shows the oscillating piston engine 100 according to FIG. 1, in a cross-section along the direction of the axis of revolution, with details of the web-shaped and bent sealing strips 26 and 33 placed thereon (as shown in the enlarged sections A and B), the working chamber and prechamber inner sealing strips 1 and 2 and the corresponding retaining grooves 3 and spring spaces or holes 4 (shown in the enlarged section C).
Figure 4:
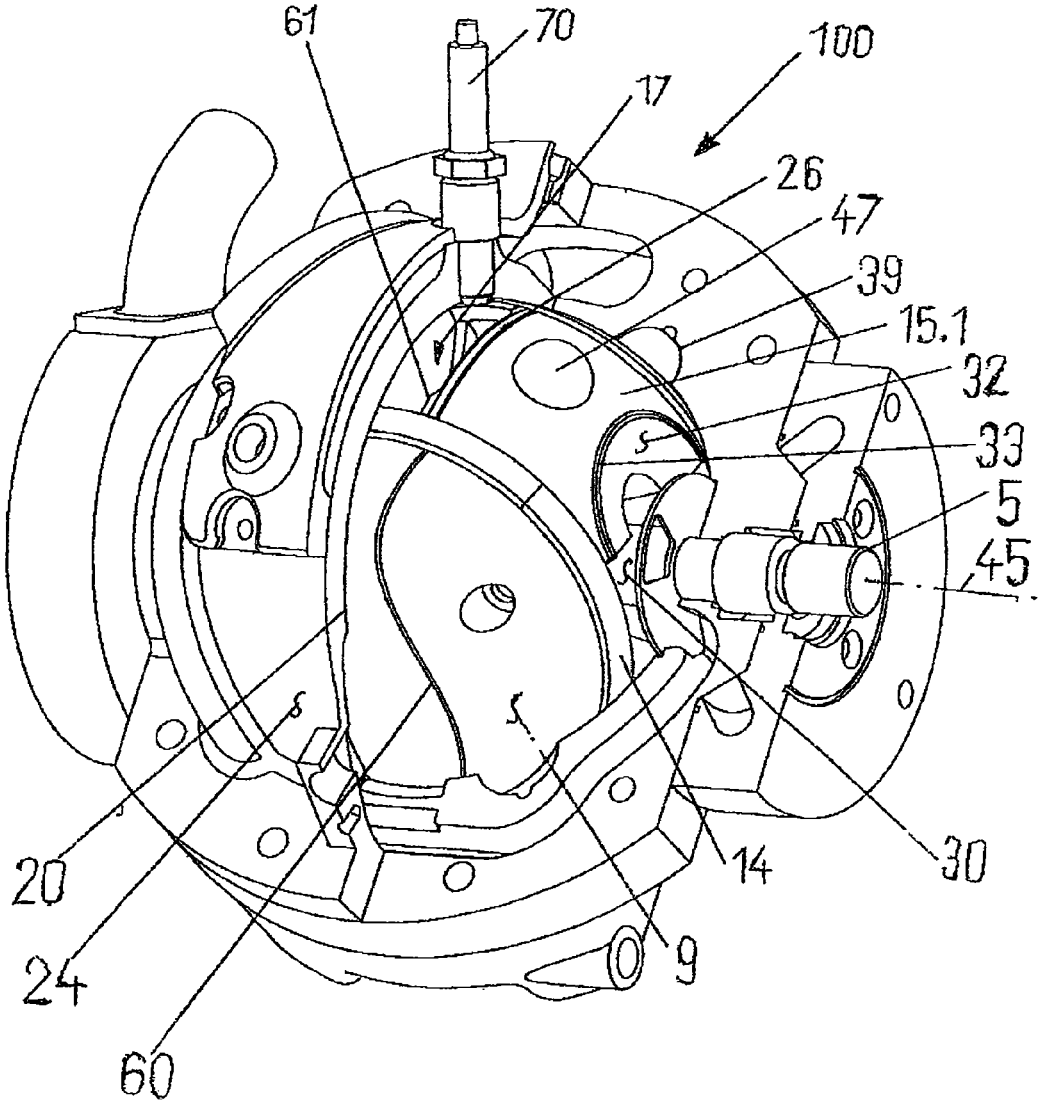
FIG. 4 shows a perspective, partially cutaway view of the oscillating piston engine 100 according to FIG. 1, comprising the spherical housing 24, on the periphery of the respective piston 15, guide elements 47 engaging in a corresponding guide groove 39 in the housing 24 for controlling the oscillating movements of the pistons 15 about the oscillation axis 46, working chambers 17 and prechambers 30 between the pistons 15 and curved sealing strip 60 on the respective dome cover 9.

The oscillating piston engine 100 can (as indicated in FIGS. 2-4) be operated as a self-igniter. Alternatively, the oscillating piston engine 100 can be fitted with a spark plug (not shown in the figures) for igniting the fuel injected into one of the working chambers 17 in order to operate the oscillating piston engine 100 as an external igniter.

The housing inner wall 20 has at least one inlet opening 40 and at least one outlet opening 41 which on the one hand allow the working chamber 17 respectively rotating past the inlet opening 40 to be filled with air in the case of a self-igniter or with an air-fuel mixture in the case of an external igniter and on the other hand, allow the expulsion of the exhaust gases produced by the combustion at the outlet opening 41 after rotation of this working chamber 17 through about 180 degrees about the axis of revolution 45. The lengths of the inlet opening 40 or output opening 41 determine the control times for fluid change in the oscillating piston engine 100, i.e. the opening time or the rotation angle of the filling or expulsion can thus be influenced. The widths of the inlet opening 40 or outlet opening 41 are obtained from the fact that the sealing strips 60 placed on the dome covers 9 during rotation about the axis of revolution 45 and the simultaneous oscillating movement of the pistons 15 about the oscillation axis 46 must be located permanently between these openings 40, 41 and the guide grooves 39 and must not penetrate into the opening or groove region. As a result, the openings 40, 41 are shielded from lubricating fluid which can come from the lubrication of the guide members 47 in the guide grooves 39 between the dome cover 9 and the housing inner side 20 of the housing 24.

Possible embodiments of a sealing system according to the invention of an oscillating piston machine are described hereinafter with reference to FIGS. 1 to 4.

As shown in FIGS. 1 and 2, the sealing system according to the invention can consist of four working chamber inner seals 1 and four prechamber inner seals 2 which are guided in single retaining grooves 3 via spring spaces 4 and corrugated springs 48 being arranged in the spring spaces 4 (but not shown in FIGS. 1 and 2) in these spring spaces 4 and which are pressed out from the retaining grooves 3 to seal onto the revolving oscillating shaft 5 in the central cylindrical working chamber base region 6 and onto the piston wall region 7 whereby the spring spaces 4 can be supplied with lubricating fluid from the cavities 8 under the dome covers 9. Between the oscillating shaft sides 10 and the piston contact surfaces 11 preferably metallic, resilient O rings 12 optionally slotted on the inside are inserted in flattened semicircular grooves 50 which can be flooded with lubricating fluid from the revolving oscillating shaft 5 through gaps 13 to improve the gap seal and reduce the friction.

The circular, at least singly divided piston rings 14 embrace the oscillating pistons 15 close to the substantially plane contact sides 16 of the dome cover 9 and comprise a spherical wedge-shaped roof profile 18 which projects over the side walls 22 of the working chambers 17. Single or, as shown, double oblique grooves 19 inserted in the oscillating piston structure enclose the spring spaces 4 in which conically rolled corrugated springs 48 not shown as well as a possible flooding with pressurised lubricating fluid by means of a connection 23 to the cavities 8 under the dome covers 9 cause pressing pressure against the housing inner wall 20. The free inner surfaces of the roof profile 18 will automatically increase the pressing pressure on the housing inner wall 20 during a pressure rise in the working chambers 17 by means of acting thereupon. The sealing effect of the respective piston ring 14 is thereby improved.

The piston wall regions 7 are preferably concavely arched. Under this assumption, the shape of the roof profile 18 of the respective piston ring 14 allows the formation of working chambers 17 or prechambers 30 having particularly large volumes.

The oblique position of the oblique grooves 19 serves the purpose of closing the groove region towards the working chambers 17 and the prechambers 30 by sealing edges 28 and preventing blowing through between working chambers 17 and prechambers 30 even in the presence of play between the groove bottoms 29 and the ends of the piston rings 14.

Sealing strips 26 (hereinafter "A-sealing strips 26") placed on the working chamber inner faces 25 in a web shape likewise have 1-2 retaining groove(s) 27 being provided in the piston, running radially to the spherical housing 24 along the working chamber inner faces 25, which retaining grooves, together with the A-sealing strips 26, enclose a spring space 4 in which spiral compression springs 35 or corrugated springs 48 can be enclosed. Together with the centrifugal force as a result of the rotation of the pistons 15 during operation of the oscillating piston machine 100, these ensure a pressing pressure which can be increased by supplying lubricating fluid by means of the connections 23 from the cavities 31 in the pistons which also prevents the underblowing of the A-sealing strips 26 from the working chambers 17 in the direction of the prechambers 30. Furthermore, the projection 61 of this A-sealing strip 26 projecting into the working chamber also effects an increase in the pressing pressure on the housing inner wall 20 during a pressure rise.

The sealing strips 33 (hereinafter "V-sealing strips 33") placed on the prechamber inner surfaces 32, which follow the contour of the prechamber inner surfaces 32 in an arc shape run in an at least single retaining groove 34 and are each pressed centrally and on both sides by a total of 2-6 helical compression springs 35 in (each forming a spring space) holes 36 under the retaining groove 34 or by conically rolled shaft springs 48 not shown onto the housing inner wall 20. Likewise, these strips can have a projection 61 projecting into one of the prechambers 30 which effects an increase in the pressing pressure of the V-sealing strip 33 due to the influence of the chamber inner pressure on the projection 61.

Both the A-sealing strips 26 and also the V-sealing strips 33 run adapted on both sides under the piston rings 14 and with the adapted contours 37 or 38 seal undersides of the piston rings against pressure from the chamber sides or against escape of lubricating fluid from the flooded oblique grooves 19 of piston rings. At the same time, these strips are held in position against displacement by the piston rings 14 and covering the sealing strip ends prevents the respective sealing strip 26, 33 from being able to penetrate into the guide grooves 39 and/or the inlet opening 40 and/or the outlet opening 41 in the spherical housing inner wall 20 during oscillating movements of the pistons 15.

For the purposes of higher specific pressing of the sealing elements, these sealing elements can be provided with recesses 42 on the sliding sealing side so that only partial surfaces 43 contact the housing inner wall 20 (FIG. 3). The smaller the contact surfaces 43 of the sealing elements on the housing inner wall 20 are selected, the greater is the specific pressing pressure of these sealing elements for a given pressing and the more sealing losses can be reduced in this way. Thus, a better seal is achieved particularly against pressure of gaseous fluids such as air, combustion mixture and combustion gases.

In FIGS. 2 and 3 the sealing elements which rest slidingly on the housing inner wall 20 during operation of the oscillating piston machine 100 are shown without contacting the same at short distances for better identification of their contours.

If the lubrication of the sealing elements by lubricating fluid emerging laterally from the retaining grooves, i.e. through gap losses, should not be sufficient, it can be provided to achieve direct lubrication from the spring spaces 4 through calibrating holes 44 in the sealing element to the sliding side facing the housing inner wall 20, the piston wall sides 7 and/or the revolving oscillating shaft 5, said spring spaces 4 being flooded with the lubricating fluid.

On each dome cover 9, two sealing strips 60 are provided in the side facing the housing inner wall 20. The sealing strips 60 seal the respective dome cover 9 against the housing inner wall 20 and have the task of shielding the inlet opening 40 and the outlet opening 41 against excessive penetration of lubricating fluid.

The invention claimed is:

1. An oscillating-piston engine (100), comprising:

a spherical housing (24) having a housing center;

two oscillating pistons (15) arranged in the spherical housing (24), wherein each of the oscillating pistons (15) include two opposite piston arms (15.1, 15.2) and a piston wall region (7) connecting said two piston arms (15.1, 15.2);

a revolving oscillating shaft (5) that is rotatable about an axis of revolution (45) arranged in the housing center;

guide members (47);

a sealing system including sealing elements (1, 2, 26, 33, 12, 14);

a lubricant fluid supply line (23); and gap regions;

wherein the oscillating pistons (15) are fastened to the revolving oscillating shaft (5) in such a manner that the oscillating pistons (15) oscillate about an oscillation axis (46) perpendicular to the axis of revolution (45) and, during a revolution of the revolving oscillating shaft (5) about the axis of revolution (45), jointly revolve about the axis of revolution (45), and, when revolving, perform reciprocating oscillating movements about the oscillation axis (46) in opposite directions;

wherein at least one of the guide members (47) is provided on each of the oscillating pistons, said guide members engaging in at least one guide groove (39) formed in the housing for controlling the oscillating movements;

wherein the piston arms (15.1, 15.2) of the oscillating pistons (15) are arranged crosswise relative to the oscillation axis (46) in such a manner that four intermediate spaces (17, 30) are formed between the piston arms (15.1, 15.2) of the oscillating pistons (15), the piston wall regions (7) of the oscillating pistons (15), a surface region (6) of the revolving oscillating shaft (5) and a housing inner wall (20);

wherein each of two of the four intermediate spaces form a working chamber (17) and each of the other two of the four intermediate spaces form a prechamber and each of the piston arms (15.1, 15.2) of the oscillating pistons (15) separates one of the working chambers (17) from one of the prechambers (30);

wherein at least one inlet opening (40) for filling the working chamber (17) with air or air-fuel mixture is provided in the housing inner wall (20);

wherein at least one outlet opening (41) for expelling combustion gases is provided in the housing inner wall (20);

wherein, between each of the piston arms (15.1, 15.2) of each of the oscillating pistons (15) and the housing inner wall (20), at least one of the gap regions is provided;

wherein, between each of the piston arms (15.1, 15.2) of each of the oscillating pistons(15) and the revolving oscillating shaft (5), at least one of the gap regions is provided;

wherein, between each of the piston arms (15.1, 15.2) of a first of the oscillating pistons (15) and the piston wall region (7) of a second of the oscillating pistons, at least one of the gap regions is provided;

wherein, between each of the piston arms (15.1, 15.2) of the second of the oscillating pistons (15) and the piston wall region (7) of the first of the oscillating pistons (15), at least one of the gap regions is provided;

wherein each of the oscillating pistons (15) has edges on a working chamber side and a prechamber side, wherein each of the edges adjoin at least one of the gap regions and during operation of the engine execute relative movements in relation to the housing inner wall (20), the revolving oscillating shaft (5) and the piston wall regions (7);

wherein a device for lubricating the guide members (47) with a lubricating fluid is provided;

wherein each of the sealing elements (1, 2, 26, 33, 12, 14) is constructed as at least one of a sealing strip (1, 2, 26, 33) or a sealing ring (12, 14) for closing the gap regions;

wherein the sealing elements are lubricated with a lubricating fluid via the lubricant fluid supply line (23);

wherein the sealing elements (1, 2, 26, 33, 12, 14) are arranged at or near the edges of each of the oscillating pistons (15) in relation to the guide members (47), the at least one guide groove (39), the prechambers (30) and the working chambers (17) and close in a sealing manner the gap regions against to prevent pressure loss in the working chambers (17) and prechambers (30) and to prevent penetration of the respective lubricating fluid into the prechambers (30) and the working chambers (17);

wherein each one of the guide members (47) is arranged at the periphery of one of the oscillating pistons (15) in one of the gap regions that is provided between the housing inner wall (20) and the one of the oscillating pistons (15) and extending between one of working chambers (17) and one of the prechambers (30) and being closed by means of at least two of the sealing strips (26, 33), one of these at least two of the sealing strips (26) being placed on a working chamber inner surface (25) and the other one of these at least two of the sealing strips (33) being placed on a prechamber inner surface (32) and one of the guide members (47) being arranged between the at least two of the sealing strips (26, 33) and the one of the at least two of the sealing strips (26) and the other one of the at least two of the sealing strips (33) being arranged on opposite sides of the least one guide groove (39).

2. The oscillating piston engine (100) according to claim 1, wherein the at least one inlet opening (40) and the at least one outlet opening (41) are sealed against the penetration of lubricating fluid by sealing strips (60), each of the sealing strips running between one of the at least one guide groove (39) for one of the oscillating pistons (15) and one of the at least one inlet and outlet openings (40, 41) without penetrating therein, each of the sealing strips (60) being fastened to a periphery of the piston rear sides.

3. The oscillating piston engine (100) according to claim 1, wherein the sealing elements are stably positioned in at least single retaining grooves (3, 27, 34) or oblique grooves (19) and sides of the sealing elements (1, 14, 26, 33, 60) substantially opposite to these grooves (3, 19, 27, 34) move as sliding sealing surfaces on the two oscillating pistons (15), the piston arms (15.1, 15.2), and the housing inner wall (20).

4. The oscillating piston engine (100) according to claim 1, wherein one flattened semicircular groove (50) is respectively formed in a side surface (10) of the revolving oscillating shaft (5) about the oscillation axis (46) and on a piston contact surface (11) of the oscillating pistons (15) adjacent to the side surface (10), and wherein an O-ring (12), that is made of metal and optionally internally slotted and fits into the respective flattened semicircular groove (50) is used as a sealing element between the side surface (10) and the piston contact surface (11), and wherein a spring region of the O-ring (12) and the flattening of the semicircular grooves (50) are matched so that thermal expansions of the oscillating pistons (15) perpendicular to the oscillation axis (46) are absorbed in an elastic and sealing manner.

5. The oscillating piston engine (100) according to claim 1, comprising sealing rings, each of the sealing rings embodied as a piston ring (14) that surrounds one of the oscillating pistons (15) in a circular manner and is divided radially at least once, is positioned on the respective piston wall region (7) by single or double oblique grooves (19) in such a manner that respectively one sealing edge (28) is formed on the respective piston wall region (7) to prevent underblowing of the respective piston ring (14) with a gaseous fluid as a result of a pressure in one of the working chambers (17) and therefore blow-off of the gaseous fluid via one of the oblique grooves (19) to the prechambers (30).

6. The oscillating piston engine (100) according to claim 5, wherein the piston ring (14) is designed with a roof profile (18) that projects into the prechambers (30) and the working chambers (17).

7. The oscillating piston engine (100) according to claim 6, wherein the sealing strip (26) is placed in a web shape on at least one of the piston arms (15.1, 15.2) on a working chamber inner surface (25);

wherein the sealing strip (33) follows the contour of the prechamber inner surface (32) and is placed on a prechamber inner surface (32), wherein the respective sealing strip (26, 33) has contours (37, 38) matched to the inner sides of the roof profile (18) of the piston rings (14) at each of its ends, wherein the contours of the respective sealing strip (26, 33) run under the piston rings (14) to prevent blowing a gaseous fluid through from the working chambers (17) to the prechambers (30) and incursions of lubricating fluid in the respective chambers (17, 30), and wherein the contours of the respective sealing strip (26, 33) serve as a position holder for the respective sealing strip (26, 33) which prevents the respective sealing strip (26, 33) from penetrating into at least one of the guide groove (39), the inlet opening (40), or the outlet opening (41) in the spherical housing inner wall (20) during an oscillating movement of the piston.

8. The oscillating piston engine (100) according to claim 1, wherein at least one sealing strip (26, 33) is arranged on at least one of the oscillating pistons (15) on a side facing the housing inner wall (20), wherein the at least one sealing strip (26, 33) is provided with at least one projection (61) projecting into at least one of one of the working chambers (17) or one of the prechambers (30), which, due to the internal pressure of the respective chamber (17, 30) exerts a pressure onto the housing inner wall (20) and therefore effects automatic sealing against blowing through on the housing side.

9. The oscillating piston engine (100) according to claim 1, wherein the respective sealing element (1, 2, 12, 14, 26, 33, 60) is arranged in an at least single retaining groove (3, 19, 27, 34), wherein a spring space (4, 36) intended to receive a spring (48, 35), preferably a corrugated spring (48), is formed between the retaining groove and the sealing element (1, 2, 12, 14, 26, 33, 60), and wherein a spring force of a spring (48, 35) arranged in the spring space (4, 36) acting on the respective sealing element (1, 2, 12, 14, 26, 33, 60) effects a pressing pressure of the respective sealing element (1, 2, 12, 14, 26, 33, 60) against at least one of the housing inner wall (20), the piston wall region (7), or the revolving oscillating shaft (5).

10. The oscillating piston engine (100) according to claim 1 wherein the respective groove (3, 19, 27, 34) and the sealing element (1, 2, 12, 14, 26, 33, 60) arranged in the respective groove enclose a space (4) into which lubricating fluid is introduced under pressure through the lubricant fluid supply line (23), whereby both the pressing pressure of the sealing elements (1, 2, 12, 14, 26, 33, 60) and also the sealing effect against underblowing is intensified and due to gap losses, lubrication is achieved on at least one of the housing inner wall (20), the piston wall region (7), or the revolving oscillating shaft (5).

11. The oscillating piston engine (100) according to claim 10, wherein the lubrication of the sealing elements (1, 2, 12, 14, 26, 33, 60) on at least one of the housing inner wall (20), the piston wall region (7), or the revolving oscillating shaft (5) is improved by exposing at least one of the housing inner wall (20), the piston wall region (7), or the revolving oscillating shaft (5) directly to lubricating fluid from the respective space (4) through at least one calibrating hole (44) in at least one of the sealing element(s) (1, 2, 12, 14, 26, 33, 60), and wherein the respective space (4) is flooded with the lubricating fluid.

12. The oscillating piston engine (100) according to claim 1, wherein at least one of the sealing elements (1, 2, 12, 14, 26, 33, 60) rests on the housing inner wall (20), the piston wall region (7) and/or the revolving oscillating shaft (5) and has at least one recess (42) which reduces the contact surface (43) of the sealing element (60) on the housing inner wall (20), the piston wall region (7) and/or the revolving oscillating shaft (5), wherein at given pressure, the specific pressing pressure of the sealing element is increased and sealing losses are therefore reduced.

* * * * *